US007168401B2

(12) United States Patent
Johnson

(10) Patent No.: US 7,168,401 B2
(45) Date of Patent: Jan. 30, 2007

(54) MULTI-LOCATION FUEL INJECTION SYSTEM

(75) Inventor: Daniel J. Johnson, Thief River Falls, MN (US)

(73) Assignee: Arctic Cat, Inc., Thief River Falls, MN (US)

( * ) Notice: Subject to any disclaimer, the term of this patent is extended or adjusted under 35 U.S.C. 154(b) by 0 days.

(21) Appl. No.: 11/143,884

(22) Filed: Jun. 2, 2005

(65) Prior Publication Data

US 2006/0272599 A1 Dec. 7, 2006

(51) Int. Cl.
*F02B 25/00* (2006.01)
*F02B 33/04* (2006.01)

(52) U.S. Cl. ..... 123/73 A; 123/73 AD; 123/73 B

(58) Field of Classification Search ..... 123/73 A, 123/73 C, 73 B, 73 BA, 73 CA, 73 CB, 123/73 PP, 73 AD
See application file for complete search history.

(56) References Cited

U.S. PATENT DOCUMENTS

| | | | | |
|---|---|---|---|---|
| 3,707,955 | A | 1/1973 | Ulbing | |
| 3,800,754 | A | 4/1974 | Carlson et al. | |
| 4,253,433 | A | 3/1981 | Blair | |
| 4,461,260 | A | 7/1984 | Nonaka et al. | |
| 4,469,054 | A | 9/1984 | Onishi et al. | |
| 4,779,581 | A * | 10/1988 | Maier | 123/73 A |
| 5,092,287 | A * | 3/1992 | Motoyama et al. | 123/73 A |
| 5,113,829 | A * | 5/1992 | Motoyama | 123/73 C |
| 5,146,899 | A * | 9/1992 | Tanaka et al. | 123/73 C |
| 5,181,493 | A * | 1/1993 | Motoyama et al. | 123/73 A |
| 5,251,582 | A * | 10/1993 | Mochizuki | 123/73 A |
| 5,251,584 | A * | 10/1993 | Ohkubo | 123/73 PP |
| 5,375,573 | A * | 12/1994 | Bowman | 123/73 AD |
| 5,443,045 | A | 8/1995 | Marconi | |
| 5,740,767 | A | 4/1998 | Kaku et al. | |
| 6,539,900 | B2 | 4/2003 | Laimbock | |
| 6,578,547 | B2 | 6/2003 | Piock | |
| 6,691,649 | B2 | 2/2004 | Zauner et al. | |
| 6,729,275 | B2 * | 5/2004 | Laimbock | 123/73 PP |
| 6,892,682 | B2 | 5/2005 | Ludu et al. | |
| 2002/0011223 | A1 * | 1/2002 | Zauner et al. | 123/73 B |

* cited by examiner

*Primary Examiner*—Noah P. Kamen
(74) *Attorney, Agent, or Firm*—Black Lowe & Graham, PLLC

(57) ABSTRACT

A two-stroke engine having both a direct injector and an indirect injector. The direct injector injects fuel into the cylinder without passing through the crank case. The indirect injector is in fluid communication with the crank case. It provides fuel delivery through the crank case and through a transfer channel to the cylinder. A controller is coupled to the direct injector and to the indirect injector. The controller starts, stops, and varies the fuel delivery of each injector. The controller is programmed to increase the fuel delivery of the indirect injector at a predetermined engine speed. The controller maintains primary fuel flow through the direct injector below a predetermined engine speed. The controller varies the fuel delivery based on at least one of following: engine speed, throttle position, exhaust valve position, intake air temperature, exhaust temperature, barometric pressure, coolant water temperature, and piston position.

8 Claims, 3 Drawing Sheets

MULTI-LOCATION FUEL INJECTION SYSTEM

FIELD OF THE INVENTION

This invention relates generally to fuel injection systems for internal combustion engines and, more specifically, to multipoint fuel injection in two-stroke engines.

BACKGROUND OF THE INVENTION

Two-stroke engines are widely used in various applications, such as for snowmobiles. The high power-to-weight ratios that these engines provide make them desirable. However, such engines typically emit greater amounts of pollutants, such as hydrocarbons and carbon monoxide. Efforts to reduce harmful emissions have included the use of various fuel injection systems. A standard fuel injection process employs a throttle body with a fuel and oil injection into the air flow. The flow then proceeds to the crankcase and into the cylinder under action from the piston. This may be somewhat cleaner burning than a carbureted system with a better control of the fuel delivery.

A semi-direct fuel injection process has also been developed involving injection of the fuel directly into the cylinder while channeling an air-oil mixture through the crankcase, through transfer ports then into the cylinder. Such a system may decrease emissions, but may have the effect of decreasing the peak horsepower produced at wide open throttle (WOT). Some of the loss of horsepower in such semi-direct and direct injection systems may stem from the higher crankcase and air intake temperatures that result. Feeding fuel through the crankcase tends to aid in cooling of the case. Furthermore, crankshaft bearing lubrication and piston and ring wear can be a problem with direct injection systems.

SUMMARY OF THE INVENTION

The present invention provides a cleaner burning, fuel-injected, two-stroke engine that does not suffer from a loss of horsepower at WOT.

The fuel delivery system of the present invention functions to lower the exhaust emission levels of a two-stroke engine without sacrificing a potential peak horsepower.

The present invention provides a two-stroke engine comprising a crank case, a cylinder, a transfer channel, a direct injector, and an indirect injector. The cylinder is fastened to the crank case. The transfer channel provides fluid communication between the crank case and the cylinder. The direct injector is in fluid communication with the cylinder for injection of fuel into the cylinder without passing through the crank case. The indirect injector is in fluid communication with the crank case. It provides fuel delivery through the crank case and through the transfer channel through the cylinder.

In accordance with one aspect of the invention, a controller is coupled to the direct injector and to the indirect injector. The controller varies the fuel delivery of each injector. Preferably, the controller is programmed to increase the fuel delivery of the indirect injector at a predetermined engine speed. The controller maintains primary fuel flow through the direct injector below a predetermined engine speed.

In accordance with a further aspect of the invention, the controller varies the fuel delivery based on at least one of following: engine speed, throttle position, exhaust valve position, intake air temperature, exhaust temperature, barometric pressure, cooling water temperature, and piston position.

In accordance with another aspect of the invention, a throttle body is provided to control the flow of air to the crank case. The indirect injector is in fluid communication with the throttle body for directing fuel into the air passing through the throttle body. A direct injector fuel rail and an indirect injector fuel rail are preferably provided to feed fuel to the direct injector and the indirect injector, respectively. A second direct injector in fluid communication with the cylinder is provided in some embodiments of the invention. A second direct injector receives fuel from the direct injector fuel rail, preferably separate from the throttle body fuel rail but fed fuel from a common fuel pump.

In another aspect of the invention, a second cylinder is fastened to the crank case and a second direct injector is placed in fluid communication with the second cylinder. A second direct injector receives fuel from the direct injector fuel rail.

The invention may also be defined as a fuel delivery system for a two-stroke engine having a crank case and a cylinder, the delivery system including a direct injector, a crank case injector, and a controller. The direct injector is coupled to the cylinder through a channel in the cylinder wall. The crank case injector is in fluid communication with the crank case to inject fuel into the crank case with air and oil. The controller is connected to the direct injector and to the crank case injector. The controller opens and closes the injector based on predetermined engine operating parameters, such as those mentioned above. In one preferred embodiment, the engine includes a transfer port. The direct injector feeds fuel into the transport port and then into the cylinder.

The invention may also be described as a method of fuel delivery to a two-stroke engine having a crank case cylinder. The method includes injecting fuel directly into the cylinder, feeding an air-oil mixture to the crank case through a transfer channel into the cylinder, and injecting fuel into the air-oil mixture above a predetermined engine speed.

Thus, the two-stroke engine of the present invention provides the advantages of various types of fuel injection systems all in the same engine to produce peak horsepower and lowest emissions.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
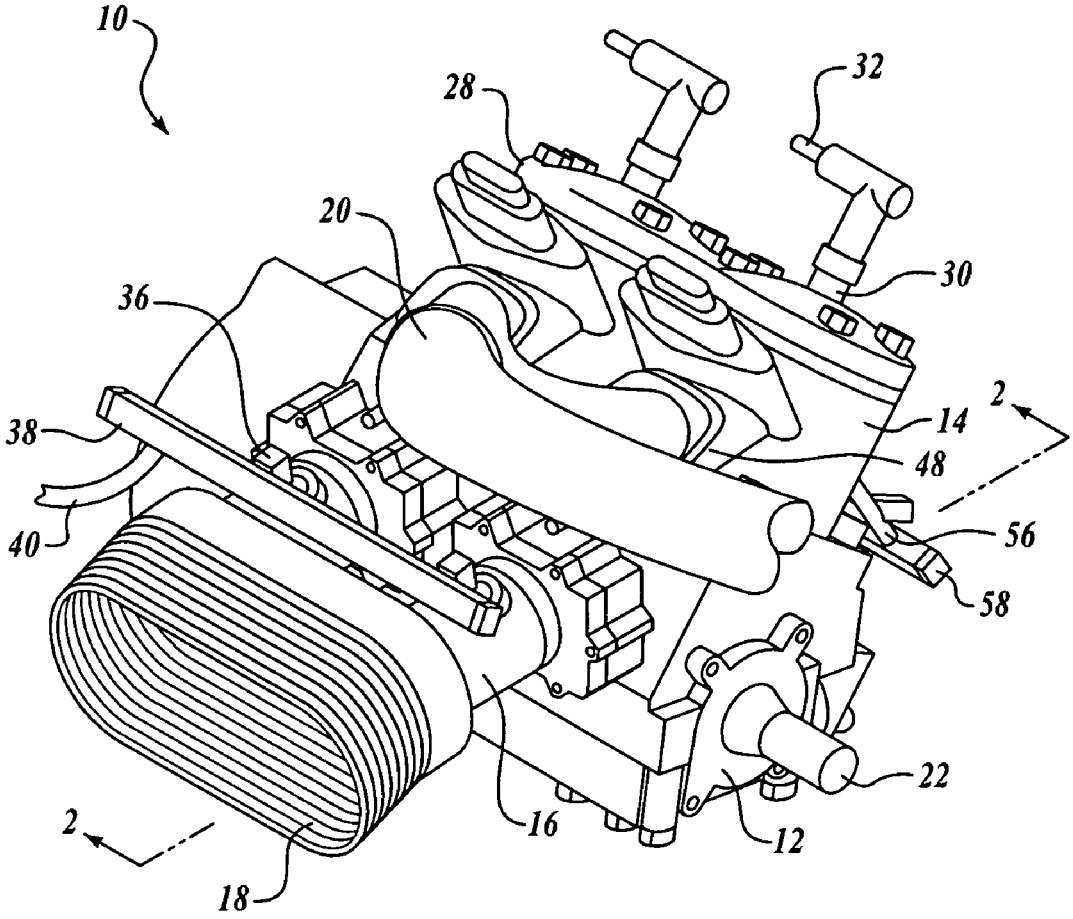
FIG. 1 is an isometric view of a two-stroke engine with multi-location fuel injection.

The figures illustrate external and cross-sectional views of a two-stroke internal combustion engine 10 utilizing the fuel delivery system of the present invention. Engine 10 is, for the most part, of a conventional design as might be utilized, for example, in a snowmobile. Engine 10 includes a crank case 12, right and left cylinders 14, right and left throttle bodies 16, an air boot 18, and an exhaust manifold 20. In actual use, engine 10 will be bolted into the chassis of the snowmobile or secured to the device with which it is to be used. Crank case 12 carries a crank shaft 22 to which is connected the drive elements of the vehicle.

Figure 2:
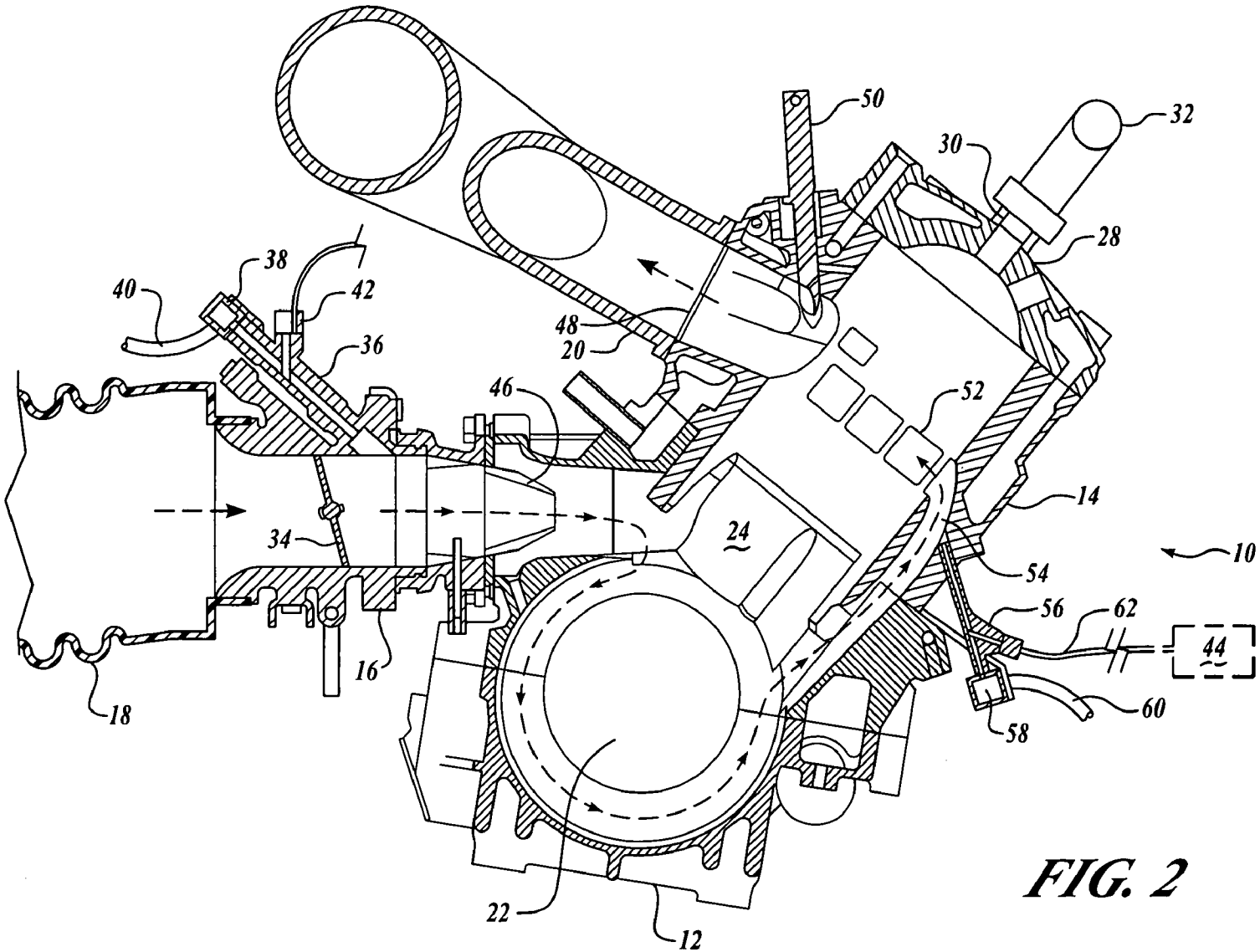
FIG. 2 is a cross-sectional view of the engine of FIG. 1.
Figure 3:
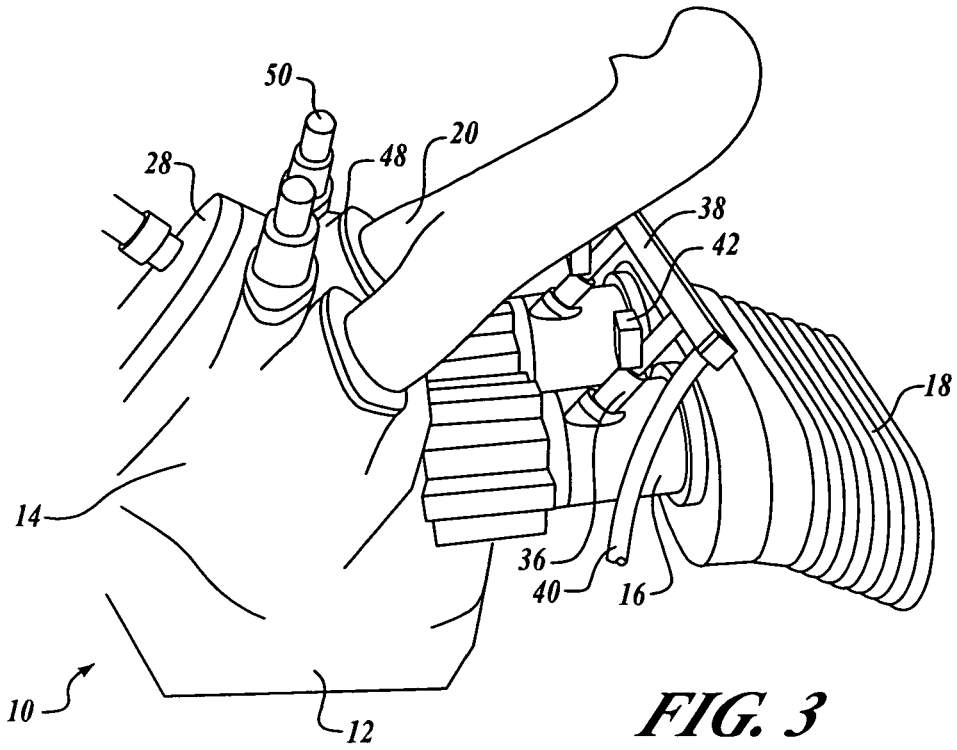
FIG. 3 is a partial isometric view of the engine.
Figure 4:
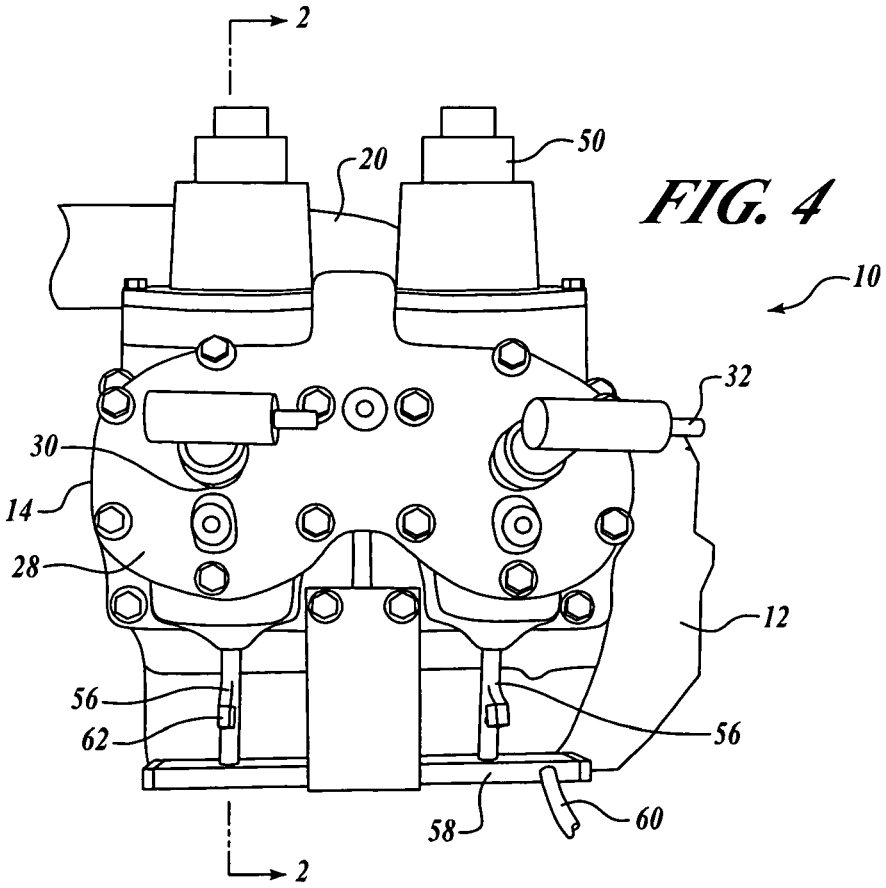
FIG. 4 is a top view of the engine.

Throughout this description, individual elements such as a piston or cylinder maybe described. This would be understood that multiple cylinders, pistons, throttle bodies, and so on may be utilized. In the preferred embodiment, a dual cylinder arrangement is employed with two cylinders, pistons, throttle bodies, and associated componentry. Referenced herein to a single element is simply to describe the basic functioning aspects and they should be interpreted to encompass multiple such elements as well. Thus, a piston 24 (see FIG. 2) is provided attached to crank shaft 22 with a connecting rod 26. Piston 24 is slidably engaged within cylinder 14 beneath a cylinder head 28. A spark plug 30 is threadably engaged within head 28 and includes a plug wire 32 for admission of compressed gases within cylinder 14.

Air is fed into cylinder 14 for combustion in a somewhat conventional manner in the preferred embodiment. Throttle body 16 includes a throttle plate 34 to vary the air flow into crank case 12 and subsequently into cylinder 14 for compression. Throttle body 16 also includes a crank case injector 36 secured downstream of throttle plate 34 for injecting fuel into the air stream as it enters crank case 12. Injecting fuel in this location aids in proper mixing of the fuel with the air and with the lubricating oil (not shown). A fuel rail 38 is provided to supply fuel from a fuel line 40 to crank case injector 36. In the preferred embodiment, fuel is fed to fuel rail 38 and kept at a constant positive pressure for feeding through crank case injector 36 as needed. The opening of crank case injector 36 to spray fuel into the air flow is controlled by control wiring 42 with signals sent from controller 44. Controller 44 varies the timing of the opening of crank case injector 36 for delivery of fuel according to various parameters including engine speed, throttle position, exhaust valve position, intake air temperature, exhaust temperature, barometric pressure, coolant water temperature, piston position (relative to top dead center position, for example), or any combination of these variables. The timing of the injector opening, the duration of the opening, and the timing of the closing may all be varied based on these parameters. Sensors are maintained in various portions of the engine to measure such variables and input information regarding such variables into controller 44 such that it can function to control crank case injector 36 as may be desirable. The fuel air mixture then proceeds through a reed valve 46 into crank case 12. Reed valve 46 is a one-way valve that only allows movement of fluid into crank case 12. Thus, when the pumping action of piston 24 induces a positive pressure on the fluid within crank case 12, such fuel air and oil mix is pumped into cylinder 14 through transfer channels 54 and transfer port 52.

Once combustion is substantially complete, spent combustion gases are expelled through exhaust ports 48 into exhaust manifold 20. An exhaust valve 50 is preferably employed to regulate exhaust port timing.

A second set of injectors is employed directly through the cylinder wall, preferably at the transfer port 52. Cylinder injectors 56 are best able to inject fuel more directly into a compression chamber of cylinder 14. Cylinder injectors 56 include fuel rails 58 and fuel lines 60 with control wiring 62 all very similar to the components used with crank case injector 36. Control wiring 62 is interconnected with controller 44 such that it may be controlled according to the same parameters as discussed above. However, controller 44 preferably activates cylinder injectors 56 at slightly different times than crank case injector 36. For example, while the engine is running at partial throttle, more fuel flow may be fed through cylinder injector 56 to result in cleaner burning of the fuel with less carbon monoxide and hydrocarbons in the exhaust gases. Even with most of the fuel being fed to through cylinder injector 56, the indirect throttle body injectors may be activated periodically to ensure proper lubrication. This help protect against excessive crankshaft bearing, piston, and ring wear.

However, at wide open throttle, additional fuel is fed to crank case injector 36. It has been found that at wide open throttle, more fuel through crank case injector 36 results in higher horsepower than simply relying upon cylinder injector 56, even when multiple cylinder injectors per cylinder are used. The increased horsepower is believed to result from cooler operating crank case temperatures that result from feeding the fuel through the crank case before it enters into the combustion chamber. Increased crank shaft bearing lubrication also results due to the fuel oil mixture injection into the crank case by the throttle body injectors.

With both sets of injectors employed, at the crank case or throttle body as well as through the cylinder, variable firing selection may be controlled based on desired performance and emissions output. The addition of cylinder injector 56 maybe carried out with only slight modifications to current engine configuration. In its simplest form, the injection ports simply need to be opened up in the cylinder wall for cylinder injector 56 to spray fuel into the transfer ports for entry into cylinder 14. In alternate embodiments, multiple injectors per cylinder may be used. Furthermore, other positions of cylinder injector 56 may be employed such as closer to crank case 12 or within transfer channel 54. Based on the programming of controller 44, the system can optimize peak horsepower on demand by using the cylinder wall injectors and the throttle body injectors at the same time. Also, by using only the cylinder wall injectors, lower level exhaust emissions are maintained. Further, multiple injectors per cylinder, firing sequentially or simultaneously with relation to engine speed, throttle position, exhaust valve position, intake air temperature, exhaust temperature, barometric pressure, coolant water temperature, piston position, or any combination of these inputs maybe employed to optimize horsepower and clean emissions.

While the preferred embodiment of the invention has been illustrated and described, as noted above, many changes can be made without departing from the spirit and scope of the invention. For example, cylinder injectors 56 may be positioned to inject fuel at boost ports rather than transfer ports or through other cylinder wall portions. Further, multiple injectors may be used at the cylinders. Accordingly, the scope of the invention is not limited by the disclosure of the preferred embodiment. Instead, the invention should be determined entirely by reference to the claims that follow.

The invention claimed is:

1. A method of fuel delivery to a two-stroke engine having a crankcase, and a cylinder, comprising:

a. fueling engine operation by injecting fuel into the cylinder downstream from the crankcase;

b. feeding an air-oil mixture to the crankcase, through a transfer channel into the cylinder; and c. fueling engine operation by injecting fuel into the air-oil mixture above a predetermined engine speed and periodically injecting fuel into the air-oil mixture below the predetermined engine speed.

2. The method of claim 1, wherein a controller varies the amount of fuel injected into the air-oil mixture and downstream from the crankcase based on the engine speed.

3. The method of claim 2, wherein more fuel is injected into the air-oil mixture at higher engine speeds.

4. The method of claim 1, wherein a controller varies the amount of fuel injected downstream from the crankcase and into the air-oil mixture based on engine speed and throttle position.

5. The method of claim 4, wherein at low engine speeds more fuel is injected downstream from the crankcase.

6. The method of claim 4, wherein the controller varies the amount of fuel injected downstream from the crankcase and into the air-oil mixture also based on at least one of exhaust temperature, intake air temperature, exhaust valve position, barometric pressure, coolant water temperature, and piston position.

7. The method of claim 1, wherein a throttle body injector is used to feed fuel to the air-oil mixture.

8. The method of claim 1, wherein injecting fuel downstream from the cylinder comprises injecting fuel through a transfer port formed in the cylinder.

* * * * *